US005676478A

United States Patent [19]

Bowman et al.

[11] Patent Number: 5,676,478

[45] Date of Patent: Oct. 14, 1997

[54] CUTTING SYSTEM FOR A PRINTING APPARATUS INCLUDING A SINGLE NOTCHED BLADE

[75] Inventors: Nicholas John Bowman, Orwell; Charles Robert Sims, Fowlmere; Martin Henry Turff, Wokingham, all of United Kingdom

[73] Assignees: Esselte Dymo N.V., St. Niklaas, Belgium; Technology Partnership PLC, Hertfordshire, United Kingdom

[21] Appl. No.: 371,173

[22] Filed: Jan. 10, 1995

[30] Foreign Application Priority Data

Jan. 18, 1994 [GB] United Kingdom ..... 9400897

[51] Int. Cl.[6] ..... B41F 11/70

[52] U.S. Cl. ..... 400/621; 400/196.1; 400/613; 400/208; 83/865

[58] Field of Search ..... 400/196, 196.1, 400/207, 208, 613, 621; 83/52, 862, 865

[56] References Cited

U.S. PATENT DOCUMENTS

| | | | |
|---|---|---|---|
| 3,921,781 | 11/1975 | Corte | 400/621 |
| 4,239,399 | 12/1980 | Johnstun | 400/613 |
| 4,243,334 | 1/1981 | Shigemori | 400/196.1 |
| 4,624,590 | 11/1986 | Richardson et al. | 400/613 |
| 4,817,844 | 4/1989 | Gerard | 226/118 |
| 5,090,285 | 2/1992 | Takajiro | 83/636 |
| 5,111,216 | 5/1992 | Richardson et al. | 400/613 |
| 5,458,423 | 10/1995 | Sims et al. | 400/621 |

FOREIGN PATENT DOCUMENTS

| | | | |
|---|---|---|---|
| 60528/86 | 7/1986 | Australia . | |
| 0007030 | 1/1980 | European Pat. Off. | 400/613 |
| 04 48 403 | 9/1991 | European Pat. Off. . | |
| 05 73 187 | 12/1993 | European Pat. Off. . | |
| 43 15 507 | 12/1994 | Germany . | |
| 0222380 | 12/1984 | Japan | 400/207 |
| 0286886 | 12/1991 | Japan | 400/621 |

OTHER PUBLICATIONS

IBM Technical Disclosure Bulletin vol. 31 No. 5 Oct. 1988 "Receipt Paper Cutoff Mechanism".

*Primary Examiner*—Christopher A. Bennett
*Attorney, Agent, or Firm*—Pennie & Edmonds

[57] ABSTRACT

A cutting system for a printing device comprises a cutting blade (58) which has a cutting surface wherein there is defined a notch (58*a*). The cutting system also has an anvil (60) on which a printing medium such as heat shrink material is supported during cutting. The cutting surface of the blade (58) cuts through the printing medium leaving an uncut area at the notch (58*a*).

33 Claims, 6 Drawing Sheets

CUTTING SYSTEM FOR A PRINTING APPARATUS INCLUDING A SINGLE NOTCHED BLADE

BACKGROUND TO THE INVENTION

The present invention relates to a cutting system for a printing apparatus. The invention is particularly but not exclusively concerned with printing apparatus which utilize a thermal print head and a platen for printing onto a printing medium. Devices of this type which are intended to receive one or more cassettes housing the printing medium and an ink ribbon for transferring the ink onto the printing medium are now widely available. They are generally called label printers.

FIELD OF THE INVENTION

One such device has as the printing medium a reel of heat-shrink material contained in a cassette. The heat-shrink material is in the form of a continuous flattened tube. The tube can be cut into individual sleeves after printing to provide heat-shrink labels. Each heat-shrink label constitutes a sleeve of heat-shrink material onto which a message has been printed and Which can be placed over a wire or the like. On heating, the heat-shrink material shrinks firmly onto the wire and can thus be used for identification. Traditionally, users have brought pre-marked sleeves and suppliers have been able to customise the sleeve in a number of ways to meet user requirements. More recently, the availability of the printing device just referred to means that customers can determine and print their own messages onto the heat-shrink material and then cut it into individual sleeves. Clearly, this has significant commercial advantages.

However, in the known printing device the heat-shrink material is cut into individual sleeves using a manual cutter. The existing device has several drawbacks. Firstly, the leader and the trailer tend to be long because of the relationship between the print zone and the cutting zone. That is, there is a predetermined distance between the print zone and the cutting zone through which the printing medium must travel between the end of printing and cutting.

Secondly, the cutting mechanism separates the sleeves entirely, leaving the user with a mixed pile of sleeves adjacent the printing device in the case where they are produced sequentially. It is quite common to wish to produce a plurality of labels in sequence, for example where a continuously numbered sequence is required.

Furthermore the known printing device has the additional disadvantage that the cassette has to be replaced frequently as its capacity is limited by the size of cassette. Heat shrink material may be relatively thick and accordingly the length which can be stored in a cassette is relatively short. This is a particular problem for industrial label printers.

It is an object of certain embodiments of the present invention to provide a printing apparatus for printing on a flattened, tubular heat shrink medium which reduces the wastage of material in leaders and trailers and which produces a plurality of labels in a more user-friendly fashion.

SUMMARY OF THE INVENTION

According to the present invention there is provided a cutting system for a printing device which comprises a cutting blade having a cutting surface in which there is defined a notch and an anvil on which a printing medium is supported during cutting so that the cutting surface of the blade cuts through the printing medium, leaving an uncut area at the notch.

Where the cutting system is used to cut a flattened tube of heat-shrink material, a plurality of cuts can be made using the above defined cutting system at spaced locations along the length of the material to provide partially connected labels. The user can thus readily tear off the labels for use after an entire strip has been produced. A suitable mechanism for making such a plurality of spaced cuts is described in more detail in our earlier European Patent Application No. 93304436.5, the contents of which are herein incorporated by reference.

That Application describes a printing device which operates with a cassette housing a printing medium comprising an image receiving tape secured to a backing layer by a layer of adhesive. The cutting system includes a blade for cutting only through the image receiving layer and not through the backing layer, a so-called "tab cut" blade. The operation of that blade is controlled so that a strip of labels can be produced where the backing layer remains continuous and the image receiving layer has a plurality of cuts at spaced locations.

In the printing device described in our earlier Application, the cutting system also includes scissors for cutting off a complete portion of the printing tape (image receiving layer and backing layer). They can be disengaged when the printing device is in the so-called multiple strip label mode.

The present invention contemplates a printing device utilizing a cutting system as above defined and having a cassette receiving bay for receiving a cassette including a reel of heat-shrink material. The cassette can include an indicating device which cooperates with the printing device to indicate that the cassette contains heat-shrink material and not conventional printing tape. That indicating device can be used to actuate the multiple strip label mode.

According to another aspect of the present invention there is provided a tape printing apparatus comprising: cutting means comprising a resiliently mounted blade having a cutting surface in which there is defined a notch; and drive means controllable to actuate the cutting means so as to cut partially through heat shrink material on which a message has been printed.

Preferably, the drive means comprises an electric motor and a gear train. In the described embodiment, the gear train comprises a worm gear which drives through at least one intermediate gear a cam having a cam track in which rides the control arm for the resiliently mounted blade.

Preferably, the printing means comprises a platen and a print head, the platen being rotatable to act as a feeding means to feed the heat shrink material to the cutting zone. This obviates the need for a separate feeding means between the printing means and the cutting zone and thus enables the distance between the printing means and the cutting zones to be reduced.

The feeding means can be controlled to feed the material under the action of a controller which is operable to receive data input by a user representative of characters to be printed, and to calculate a length of label to be printed including the calculation of a lead length of blank material before a print start position and a lag length of blank material after a print end position. The length of label can either be calculated by the controller in dependence on the character and spaces input by a user or can be input directly by a user. Whether the label length is calculated by the controller or set by a user, lead and lag lengths are set by the controller in proportion to the label length and size of character to be printed.

The controller can thus control feeding of the material so that a final label is produced with the appropriate lead and lag and length of print. This involves controlling the distance through which the material is fed relative to the cutting zone.

The controller is operable in the described embodiment to control the feeding means via a stepper motor by converting the stored lead, lag and print length into appropriate pulse strings for supplying to the stepper motor, each pulse string having an appropriate number of pulses equivalent to the stored feed length.

According to a further aspect of the invention there is provided a cassette for use with a printing device, said cassette holding a length of a printing medium tape, said cassette having a first portion which is arranged to be received within the printing device and a second portion which, in use, is arranged externally of the printing device, said second portion being arranged to store said tape.

This cassette configuration has the advantage that the capacity of the cassette can be increased without having to increase the size of the printing device. This is particularly advantageous when the print medium is relatively thick and is, for example, heat shrink material. Furthermore the additionally capacity makes the cassette particularly useful in applications where large quantities of labels are required, for example in industrial applications. Additionally, it is possible to provide a printing device which will be able to operate both with conventional cassettes and the above described modified cassettes.

Preferably the printing device is provided with an opening between the cassette receiving bay and an exterior of the printing device, whereby the cassette receiving bay is arranged to receive the first portion of the cassette, the second cassette portion is arranged externally of the print device and an intermediate portion of the cassette, connecting the first and second portions is arranged to be received in said opening.

The printing medium tape may be stored in a concertina fashion in said second portion. The second portion of the cassette may be substantially elongate and a long surface thereof may conform to an outer surface of the printing device. In this way, it is possible to achieve a relatively compact combination of a cassette and printing device.

For a better understanding of the present invention, and to show how the same may be carried into effect, reference will now be made by way of example to the accompanying drawings.

DESCRIPTION OF THE PREFERRED EMBODIMENTS

Figure 1:
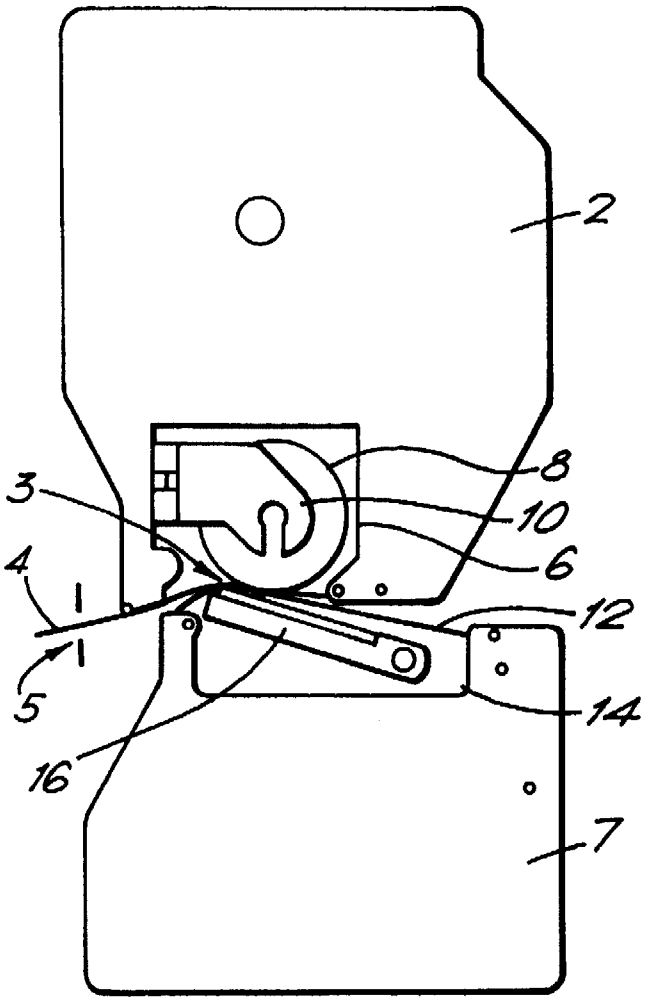
FIG. 1 is a plan view showing two cassettes inserted in a printing device.

FIG. 1 shows in plan view two cassettes arranged in a printing device. The upper cassette 2 contains a supply of flattened heat-shrink tubing 4 which passes through a print zone 3 of the printer to an outlet 5 of the printer. The heat shrink tubing may for example be a thin-wall semi-flexible modified polyvinylidene fluoride (PVDF) sleeving or similar material. The cassette 2 has a recess 6 for accommodating a platen 8 of the printer. The platen 8 is mounted for rotation within a cage moulding 10.

The lower cassette 7 contains a thermal transfer ribbon which extends from a supply spool to a take-up spool within the cassette 7. The thermal transfer ribbon 12 extends through the print zone 3 in overlap with the heat-shrink material 4. The cassette 7 has a recess 14 for receiving a print head 16 of the printer. The print head 16 is movable between an operative position, shown in FIG. 1, in which it is in contact with the platen and holds the thermal transfer ribbon 12 and the heat-shrink material 4 in overlap between the print head and the platen and an inoperative position in which it is moved away from the platen to release the thermal transfer ribbon and heat-shrink material. In the operative position, the platen is rotated to cause heat-shrink material to be driven past the print head and the print head is controlled to print an image onto the material by thermal transfer of ink from the ribbon 12. The print head is a conventional thermal print head having an array of pixels each of which can be thermally activated in accordance with the desired image to be printed.

Figure 2:
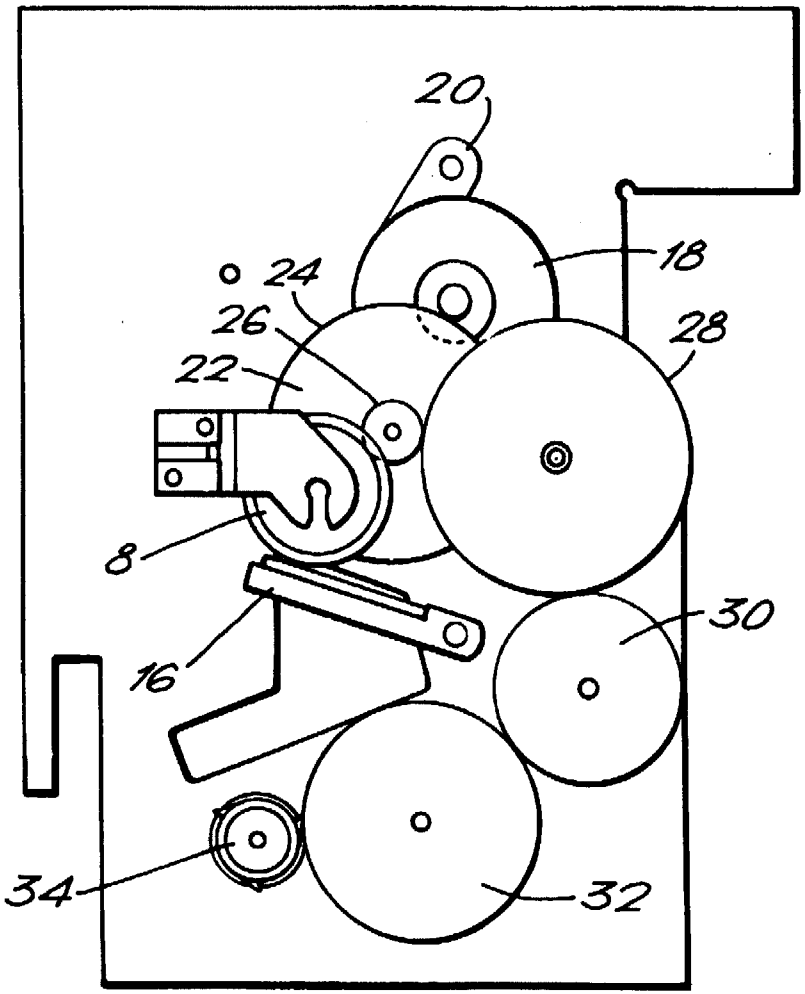
FIG. 2 is a diagrammatic plan view showing a drive train for a platen of the printing device.

FIG. 2 shows the drive train of the printing device. The printing device carries a stepper motor 18 secured to the base of the printing device by a bracket 20. The motor drives a double radius gear 22 on its larger diameter 24 while its smaller diameter 26 drives the platen 8 and a second gear wheel 28. The second gear wheel 28 drives through an intermediate gear 30 a third gear 32 which drives the take-up spool for the ink ribbon in the cassette 7. The take-up spool is designated by reference numeral 34 in FIG. 2.

The stepper motor 18 drives the platen 8 in steps so that for each position of the platen a line of print is printed on the image receiving tape 4. The platen 8 drives the heat-shrink material through the print zone under the action of its own rotation. The rotation of the platen and the energisation of the print head 16 are controlled by a microprocessor as described in more detail hereinafter.

Figure 4:
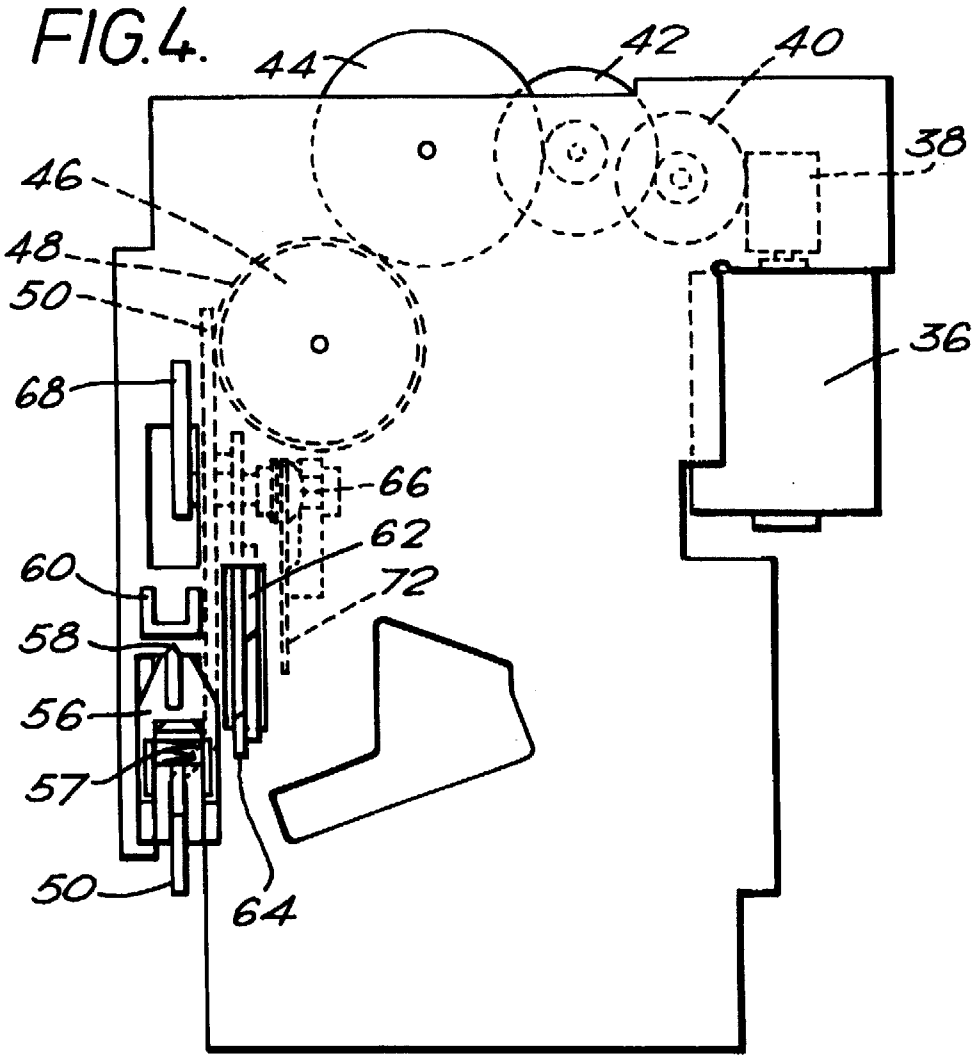
FIGS. 3 and 4 are side and plan views respectively of a cutting mechanism of the printing device.
Figure 3:
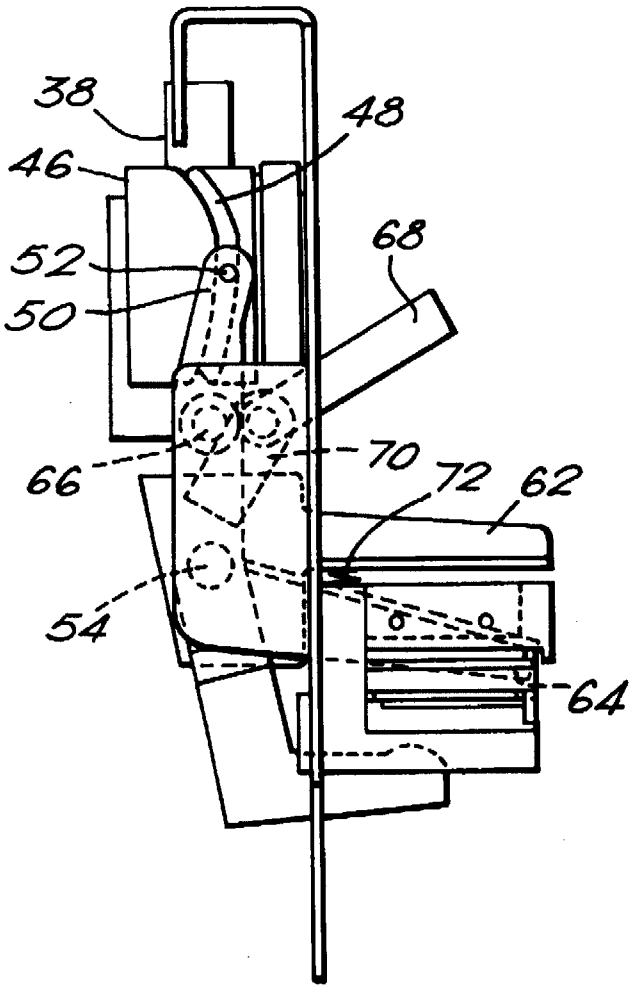
Figure 7:
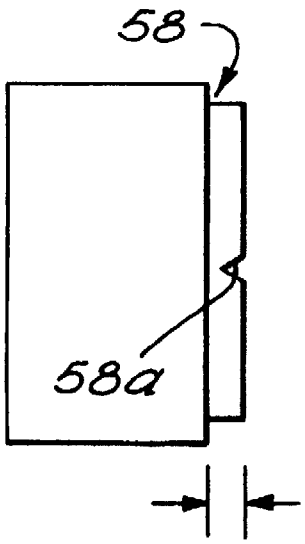
FIG. 7 is an enlarged view of the blade of the cutting system.

FIG. 3 and 4 are side views and plan views respectively of a cutting mechanism of the printing device. A cutter motor 36 drives a worm gear 38. This drives a gear train comprising three gears 40,42,44, the last gear 44 then driving a cam 46. The cam 46 has in its surface a cam track 48 extending circumferentially and asymmetrically. A sleeve cut lever arm 50 runs in the cam track 48 via a pin 52. The sleeve cut lever arm is pivotably mounted about a pivot point 54 and is arranged so that it can be brought into contact with a spring loaded blade-holder designated generally by reference numeral 56 to bring a blade 58 into contact with an anvil 60. The blade holder 56 is biased by a spring 57. In an alternative arrangement, the anvil 60 could be biased instead of the blade holder 56. As shown in FIG. 7, blade 58 is designed to cut through the heat-shrink material except in a central area defined by a notch 58*a*, to define a sleeve-type label connected to the rest of the heat-shrink material by a small connection area.

As described in our earlier Application No. 93304436.5, the machine has two cooperating blades 62,64 operating as scissors. The blade 62 remains stationary while the blade 64 is pivoted about pivot point 54. A pin 66 secures the blade 64 to the sleeve cut lever arm 50 so that the blade 64 moves with the lever arm 50. In this way upward movement of the blade 64 occurs in response to movement of the sleeve cut lever arm 50 in the cam track 48. The pin 66 can be disengaged from the sleeve cut lever arm 50 by use of a disengagement lever 68. The disengagement lever causes a cam 70 to rotate, the surface of the cam 70 being such that its rotation allows the pin 66 to move out of contact with the lever arm 50 under the action of a spring 72.

Figure 6:
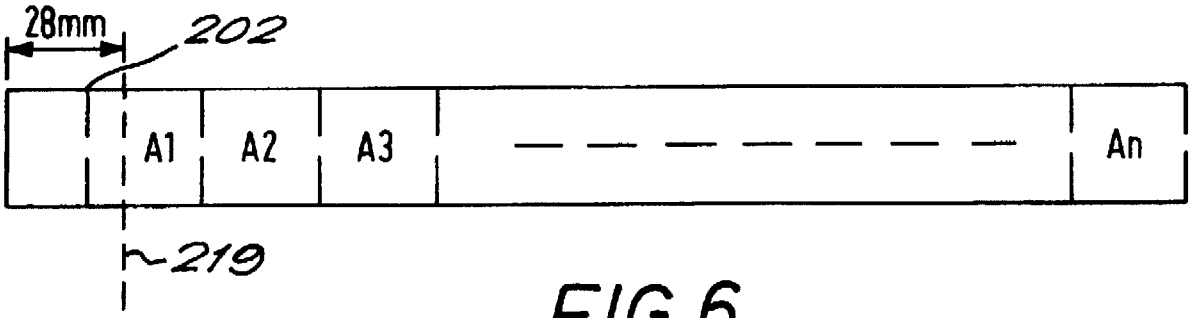
FIG. 6 is a diagram showing a strip of labels which can be produced using the printing device.

The cutting mechanism can operate in two ways. In the first mode, the pin 66 secures the blade 64 to the sleeve cut lever arm 50. As the cam 46 rotates, the sleeve cut lever arm 50 is caused to move in the track 48 into a cutting position where it brings the blade 58 into contact with the anvil 60. At the same time, the blade 64 is brought into contact with the blade 62 to perform a scissor cut. Thus, when the machine is operated with conventional image receiving tape and a so-called tab cut blade in place of blade 58, a portion of a printed tape is cut off while a tab cut is made at a short distance from the main cut. In the second, "strip label" mode, the disengagement lever 68 has been rotated so that the pin 66 no longer secures the blade 64 to the sleeve cut lever arm 50. In these circumstances, the scissors do not operate as the cam 46 rotates but instead only the blade 58 makes cuts at a series of locations. This provides the facility to have a continuous length of heat-shrink material divided into a series of sleeve-type labels connected by small connection regions (as shown in FIG. 6). The way in which this is achieved will be described in more detail hereinafter.

Figure 5:
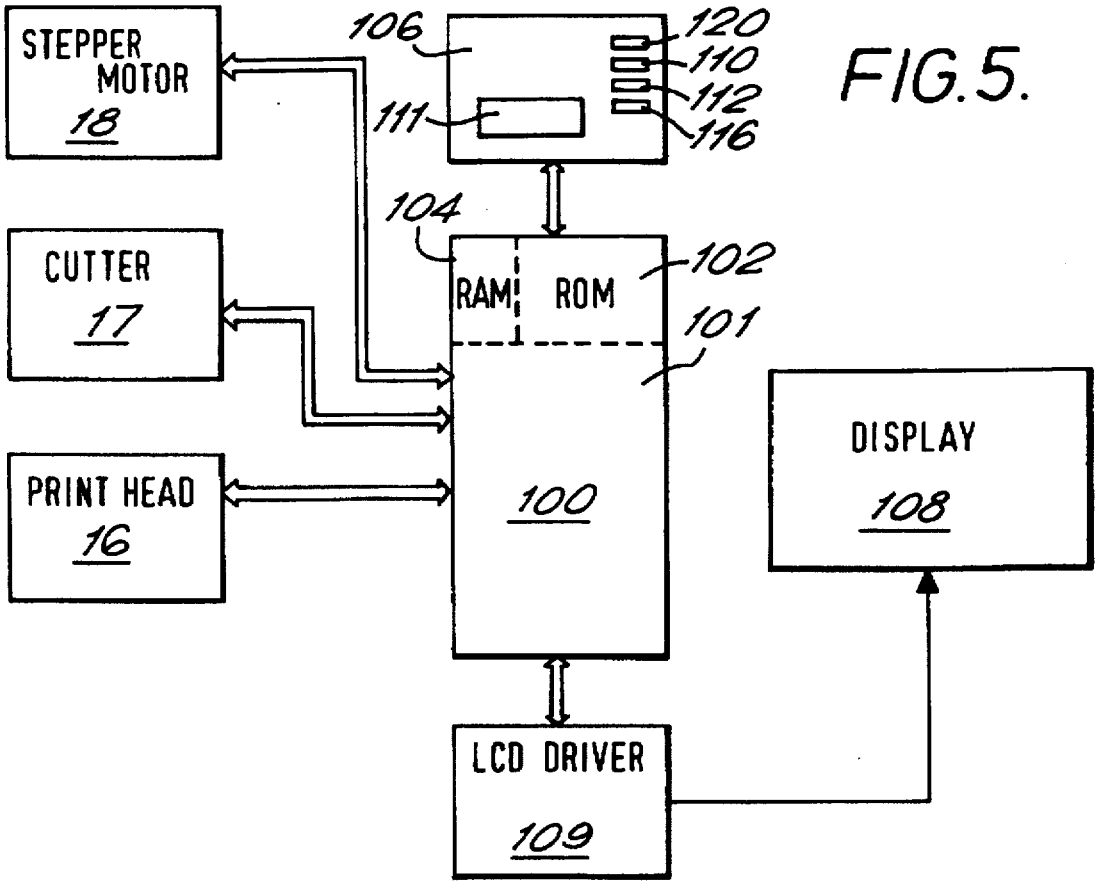
FIG. 5 is a diagrammatic sketch showing the control circuitry for the printing device.

The basic circuitry for controlling the printing device is shown in FIG. 5. There is a microprocessor chip 100 having a read only memory (ROM) 102, a microprocessor 101 and random access memory capacity indicated diagrammatically by RAM 104. The microprocessor is connected to receive data input to it from a data input device such as a keyboard 106. The microprocessor chip 100 outputs data to drive a display 108 via a display driver chip 109 and also to drive the print head 16 and the stepper motor 18 for controlling the platen 8. The microprocessor chip also controls the cutting mechanism indicated diagrammatically in FIG. 5 by cutter 17 to cut the printed tape.

Data to be printed is typed into the printing device using data input keys on the keyboard 106. The data input keys are designated generally by the block 111 but will in practice comprise a plurality of lettered and numbered keys. As the data is entered into the keyboard 106 it is supplied to the microprocessor 101 which drives the display 108 to display the data as it is entered. To do this, for each character which is entered, the microprocessor calls up a stored version of the character from a ROM 102. As the character is stored in compressed form this font data is stored temporarily in the RAM 104 and is manipulated by the microprocessor 101 to generate pixel data to form the character. This pixel data is transmitted in one form to the display 108 and in another form to the print head for printing. Character data is not passed to the print head for printing until a print operation is executed. Firstly, the characters for the label are entered and edited using function keys on the keyboard 106 in conjunction with the display 108.

Once the final form of the label has been worked out, the microprocessor has sufficient information to define the pixel data for each column to be printed and has also calculated the overall length of the label and the position of the print within the label.

That is, in this mode each label will have a certain lead length and tail length of blank material. These lead and tail lengths and the length of print are stored in the microprocessor. The lengths stored in the microprocessor can be used to control movement of the tape as described hereinafter by conversion of the stored lengths into pulses used to drive the stepper motor.

For the present application the scissor blades are disabled, for example in response to detection of insertion of a cassette containing heat-shrink material. It is then possible to produce a continuous plurality of sleeve labels, not entirely separated from one another but each being removable individually by tearing the remaining connecting portion. In order to implement this with the described printing device, the scissor cut is disabled by the disengagement lever 68. The movement of this lever can be automatically sensed by a sensor on the lever connected to the microprocessor or, alternatively, it could be manually selected by use of a key on the keyboard 106. An exemplary key is designated by reference numeral 110 in FIG. 5.

When a print operation is instigated using the print key 112, there is a length of tape (28 mm in the described embodiment) extending between the print head and the cutting location at which the last cut was made, and printing starts at the position on the material at the print head 16. For printing, a column of pixel data is transferred to the print head which prints this column on the heat-shrink material. The stepper motor then moves the material forward by one column width and the next column of data is transferred to the print head and printed. In this way, an entire label is printed. Printing of the first label starts at the zone where the material is held between the print head 16 and the platen 8. Printing is carried out until a complete label has been printed. The microprocessor has calculated a label start position 202 (FIG. 6) which is a distance spaced from the print start position 219 (FIG. 6) by an amount corresponding to the lead length of the label. When the label start position which is designated by reference numeral 202 in FIG. 6 reaches the sleeve cut blade 58 further feeding of the tape is inhibited and a cutting operation is automatically carried out to perform a cut at the lead of the label. Further feeding of the material is then commenced. The microprocessor controls the feed of material to accommodate the lead length of the label so that the distance between the label start position and the print start position matches the selected lead length. Printing is then carried out for the appropriate print length and the trail length is then fed through until the end of the label reaches the cutting zone. Feeding is stopped and cutting is commenced, at the same time defining the label start position of the next label. The process is repeated so as to commence printing at the beginning of the print start portion 219 of the next label. If a situation arises that the printing mechanism is operable when a cut is to be made, the microprocessor not only inhibits further feeding but also inhibits printing while cutting is carried out.

Figure 8:
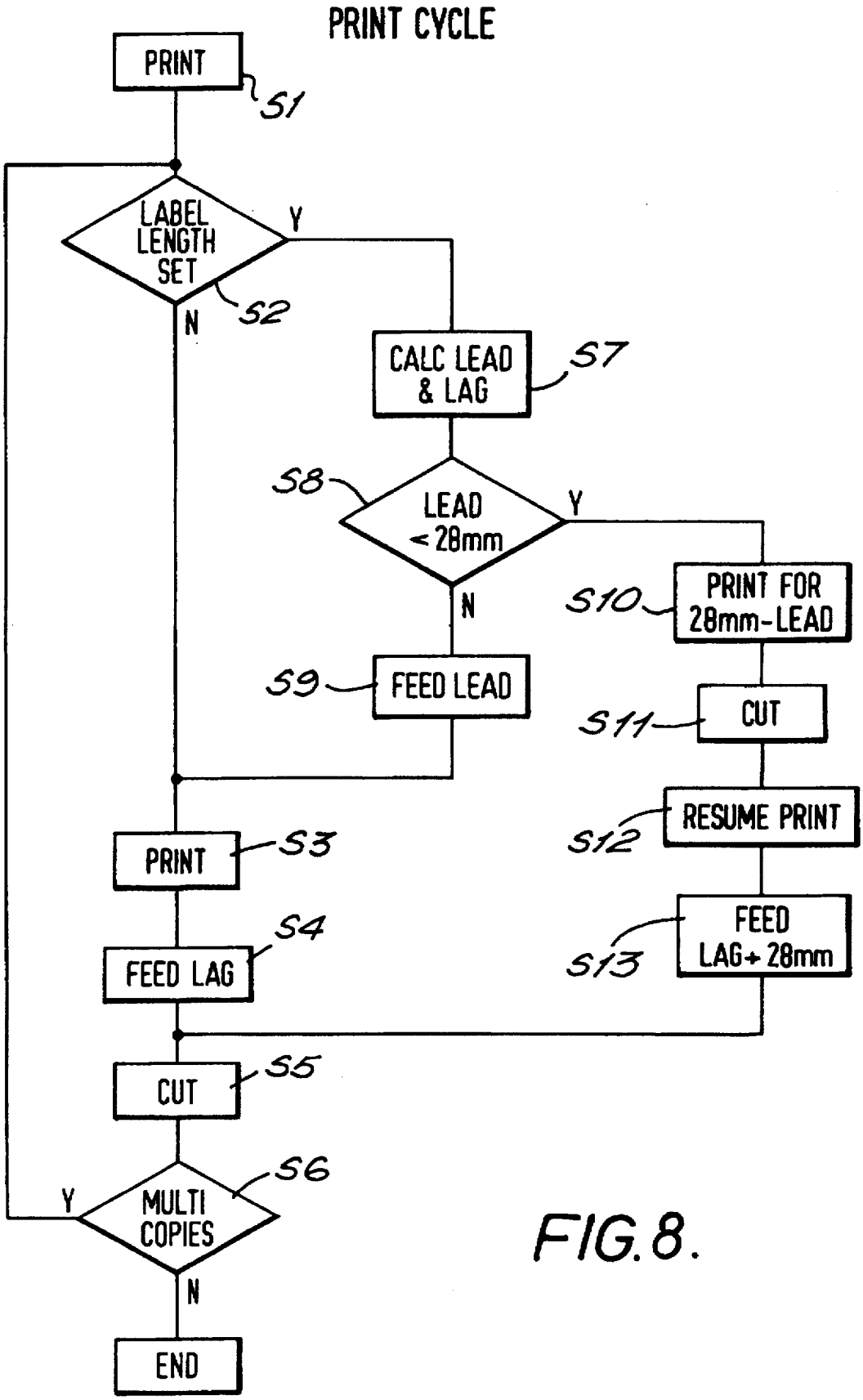
FIG. 8 is a flow diagram showing the operation of the printing device.

This is described in more detail in FIG. 8 which is a flow diagram showing the operation of the printing device. Step S1 denotes activation of a print operation by depression of the PRINT key on the keyboard. If there is no label length set (step S2) printing commences straight away (step S3). This would leave a label lead length of 28 mm. When the selected message has been printed, a lag length of 56 mm is fed (step S4) and then a cut (step S5) is made to define a label having a leader and trailer each of 28 mm. If multi-copies are selected (step S6) the loop S2 to S5 repeats. If not, the process ends.

If at step S2 the label length is set, the processor calculates at step S7 the lead and lag lengths. If the lead length is greater than 28 mm, the difference is fed out (S9) and then printing commences at step S3 as before. If the lead length is less than 28 mm (S8), printing commences at step S10 for a distance of 28 mm minus the lead length, and is then inhibited while a cut (S11) is made at step S9. Printing is resumed (S12) to the end of the message and then the material is fed for the lag length plus 28 mm to the next cut S5.

Figure 9:
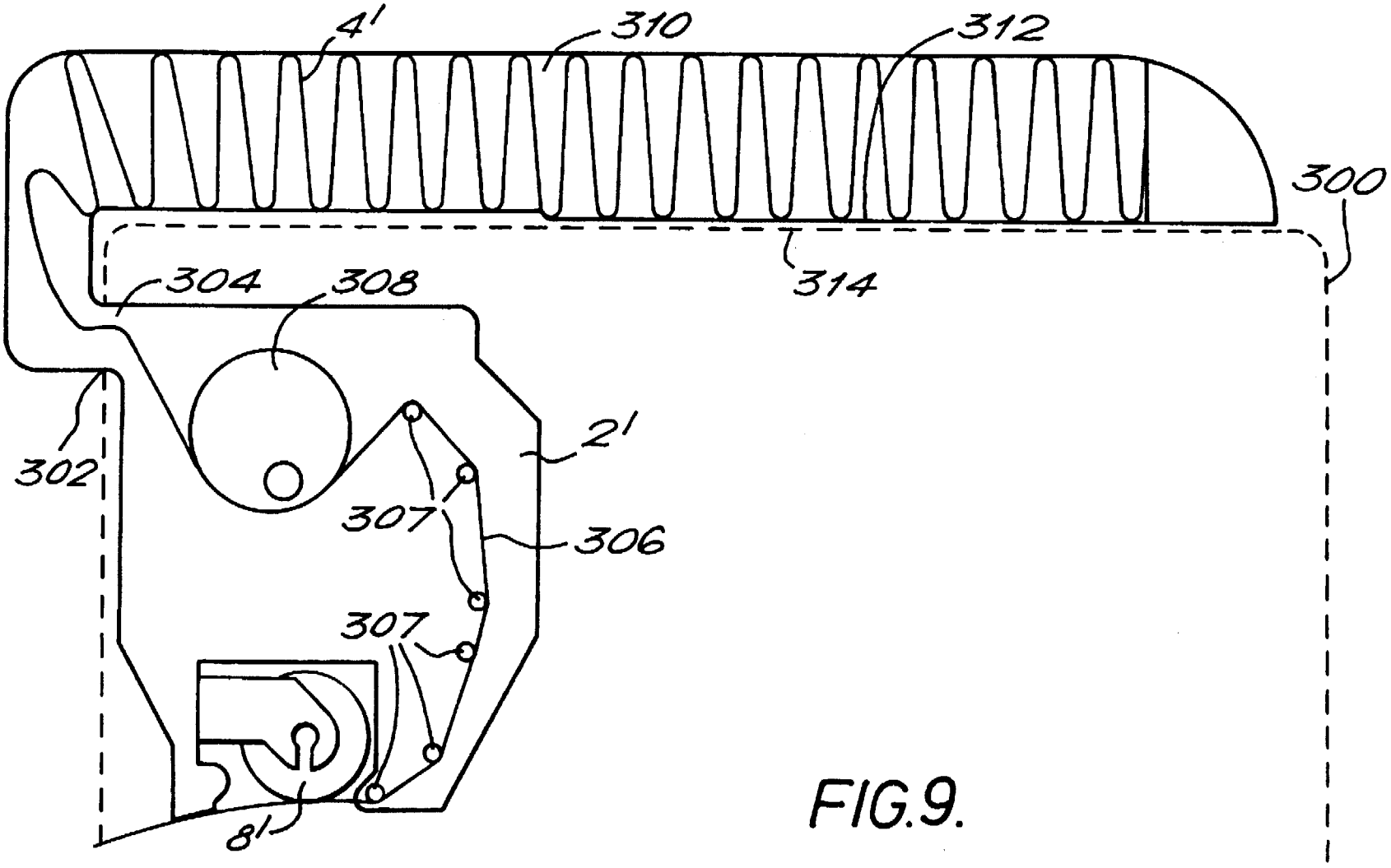
FIG. 9 shows a modified cassette which can be used instead of the upper cassette of FIG. 1.

FIG. 9 illustrates a modified cassette 2' for holding a greater length of print medium than the tape shown in FIG. 1. This cassette is particularly suited to housing heat shrink tape which tends to be more bulky than conventional tape. The outline of part of a label printing device is indicated by the reference numeral 300. The label printing device 300 is provided with an opening 302 through which a neck portion 304 of the cassette 2' extends. This opening may take the form of a suitably shaped channel at one side of the cassette receiving bay. A first part 306 of the cassette which is housed entirely within the label printing device 300 is generally conventional and comprises six guide members 307. However, the tape storage reel normally present is replaced by a guide member 308 around which the print medium moves as it is advanced.

The cassette 2' also has a tape storage portion 310 which is arranged externally of the label printing device 300. The tape storage portion 310 is connected to the neck portion 304 and has one long surface 312 which generally conforms to the shape of an outer surface 314 of the device 300. The tape 4 is stored in the storage portion 310 of the cassette in a concertina manner as can be seen in FIG. 9. In this embodiment around 10 m of tape can be held in the cassette.

The cassette receiving bay of the printing device can be closed in a conventional manner by a lid. (not shown) with the first part 306 of the cassette located therein. As the neck portion 304 of the cassette is received in the opening 302 to one side of the printing device, the closing of the cassette receiving bay is not interfered with.

In use, the platen 8' drives the tape through the printing device 300, pulling the tape from the storage portion 310, into the first part 306 of the cassette and out past the printhead.

The printing device 300 shown in outline in FIG. 9 with the cut out portion 302 for accommodating the neck portion 304 of the modified cassette is able to operate not only with the cassette shown in that Figure but also with the cassette 2 shown in FIG. 1.

The cassette can be provided with means to indicate the type of cassette present and/or the type of tape contained in the cassette. For example the printing device could be provided with a switch located on the exterior surface of the printing device which is operated by an actuater on the cassette of FIG. 9 when such a cassette is present. This can thus provide an indication of the type of cassette present. It will be appreciated that the indicating means can also take any other suitable form. The cassette shown in FIG. 1 can of course also be provided with suitable indicating means which cooperate with the printing device to provide an indication of the type of cassette and/or cassette medium provided. In the embodiment shown in FIG. 1, the indicating means would only provide an indication as to the material housed in the cassette as in that embodiment, the printing device has not been modified to operate with the cassette shown in FIG. 9.

As described above, the scissors can be disabled for example, on insertion of a heat shrink cassette. It would also be possible to provide a device in which the sleeve cutter was made inactive (e.g. by removing the sleeve cut blade) and only the scissors operated to cut off single labels. This would require an adjustment in the controller to take account of the different relative locations of the cutter and print head.

In the above described embodiment, the stepper motor 18 moves blade 58 between its cutting position and its rest position under the control of the microprocessor. However, as will be appreciated the blade 58 could be manually moved to cut the tape. For example, the printing device could be arranged to stop printing and flash a CUT message onto the display indicating that a user should perform a manual cut. The user could then manually operate the blade to provide the necessary cut. Modifications to the manner in which the blade is mounted may be necessary but can be readily devised by those skilled in the art.

Whilst the above described embodiment is concerned with the use of heat shrink material as a print medium, it will be appreciated that various aspects of the present invention are also applicable to other types of print medium. However certain features of the present invention are particularly suited to applications where the print medium is relatively thick.

In the described embodiments, the blade 58 is provided with a single cut-out portion which is centrally located. It will be appreciated that blade could alternatively be arranged to provide a plurality of connected portions between two adjacent labels. For example the blade could be arranged to provide line of perforations. The cut-out portion of the blade also need not be symmetrically located.

The specific embodiment described uses a stepper motor which controls the advance of the tape through the apparatus. However, in certain embodiments of the invention, the stepper motor may be replaced by a DC motor. In this regard reference is made to our earlier European Patent Application No. 94308084.6, the contents of which are herein incorporated by reference. In this Application, a DC motor is described which drives the tape. The speed of the motor is monitored by a shaft encoder which is arranged to rotate with a shaft of the DC motor. The print head controller uses signals from the shaft encoder to control the sequential printing of groups of pixel data. The pulses provided by the encoder can be used by the microprocessor in order to control the DC motor to feed the tape at a suitable rate to obtain the desired lead and lag lengths and label length.

What is claimed is:

1. A tape printing device comprising:

a cassette receiving bay for receiving a cassette of printing medium tape;

a single cutting blade having a cutting surface in which there is defined a notch;

an anvil for supporting printing medium tape during cutting, said blade being arranged to cooperate with the anvil during cutting; and moving means for moving the single cutting blade towards and away from the anvil to cut the printing medium tape wherein, when the single cutting blade is moved toward the anvil, the cutting blade cuts through the printing medium tape leaving an uncut area corresponding to said notch.

2. A tape printing device as claimed in claim 1, wherein an opening is provided between the cassette receiving bay and an exterior of the tape printing device, said cassette receiving bay being arranged to receive a first portion of a cassette, a second portion of the cassette being arranged externally of said tape printing device, and an intermediate portion of the cassette connecting said first and second portions being arranged to be received in said cassette receiving bay opening.

3. A tape printing device as claimed in claim 2, wherein said cassette receiving bay is so shaped as to additionally receive a cassette which is entirely received within the cassette receiving bay.

4. A tape printing device as claimed in claim 1, further comprising a device for indicating the presence of a cassette received in the cassette receiving bay, control means for controlling said tape printing device, and means which cooperate with the indicating device to thereby enable the control means to determine the type of cassette present or the type of tape present.

5. A tape printing device as claimed in claim 1, further comprising a print head which is able to print an image on heat shrink material or on conventional printing tape.

6. A tape printing device as claimed in claim 1, further comprising a device for indicating the presence of a cassette received in the cassette receiving bay, means which cooperate with the indicating device to thereby enable the tape printing device to determine the type of cassette present or the type of tape present, and control means for controlling the printing device to have a multiple strip label mode when the printing device determines that a cassette of heat shrink material is present in said cassette receiving bay, wherein the cutting blade is controlled by the control means in said multiple strip label mode to provide a series of partially connected labels.

7. A tape printing device as claimed in claim 1, further comprising printing means in the form of a platen and a print head, said platen being rotatable to act as a feeding means to feed the tape into a cutting zone.

8. A tape printing device as claimed in claim 1, which further comprises a controller which is operable to receive data input by a user representative of characters to be printed and to calculate a length of label to be printed including the calculation of a lead length of blank material before a print start position and a lag length of blank material after a print end position, and feeding means for feeding said tape, said feeding means being controlled to feed the tape under the action of the controller.

9. A tape printing device as claimed in claim 8, wherein the controller controls the feeding means via a stepper motor by converting the stored lead, lag and print length into appropriate pulse strings for supplying to the stepper motor, each pulse string having an appropriate number of pulses equivalent to the stored feed length.

10. A tape printing device as claimed in claim 1, which further comprises control means arranged to control the tape printing device to have a strip label mode of operation in which the single cutting blade is arranged to produce a plurality of cuts along a length of printing medium tape to provide a series of partially connected labels.

11. A tape printing device as claimed in claim 1, which further comprises a second cutting arrangement which is adapted to cut completely through the printing medium tape.

12. A tape printing device as claimed in claim 1, which further comprises control means for controlling the tape printing device to have a strip label mode of operation in which the single cutting blade is arranged to produce a plurality of cuts along a length of printing medium tape to provide a series of partially connected labels, a second cutting arrangement is provided to cut completely through the printing medium when desired, and disengaging means for disengaging said further cutting arrangement is provided for operation when said system is in the strip label mode.

13. A cassette for use with a tape printing device, said cassette comprising:

a supply of a printing medium tape;

a first portion which is arranged to be received within the printing device, said first portion having guide means for guiding the tape;

a second portion which, in use, is arranged externally of the printing device, said second portion being arranged to store said supply of tape; and an intermediate neck portion for connecting said first and second portions.

14. A cassette as claimed in claim 13, wherein said printing medium tape comprises heat shrink material.

15. A cassette as claimed in claim 13, wherein said printing medium tape is stored in a concertina fashion in said second portion of the cassette.

16. A cassette as claimed in claim 13, wherein said second portion of the cassette is substantially elongate and a long surface thereof conforms to an outer surface of a tape printing device.

17. A cassette as claimed in claim 13, wherein said cassette further comprises an indicating device which cooperates with a tape printing device to indicate the type of printing medium tape contained in said cassette or the type of cassette.

18. A tape printing device comprising:

a cassette receiving bay for receiving a cassette of printing medium tape;

a cassette in said cassette receiving bay, said cassette holding a length of a printing medium tape and having a first portion which is arranged to be received within the cassette receiving bay of said printing device and a second portion which, in use, is arranged externally of the printing device, said second portion being arranged to store said printing medium tape;

a single cutting blade having a cutting surface in which there is defined a notch; and an anvil on which the printing medium tape is supported during cutting so that the cutting surface of the blade cuts through the printing medium tape, leaving an uncut area at the notch.

19. A tape printing device for printing an image on a printing medium tape, said device comprising:

a cassette receiving bay for receiving a cassette of printing medium tape;

a print head arranged at a print zone;

means for driving printing medium tape past the print head, the print head arranged to print an image on print medium tape as it passes through the print zone;

a single cutting blade having a cutting surface in which there is defined a notch;

an anvil for supporting printing medium tape during cutting, said cutting surface being arranged to cooperate with the anvil during cutting; and moving means for moving one of the cutting blade and the anvil toward and away from the other, so that when one of the cutting blade and the anvil moves toward the other, the blade cuts through the printing medium tape leaving an uncut area corresponding to the notch.

20. A printing device for printing an image on a printing medium tape, said device comprising;

a cassette receiving bay for receiving a cassette of printing medium tape;

a single cutting blade having a cutting surface in which a notch is defined;

an anvil for supporting a printing medium tape during cutting so that the cutting surface of the blade is arranged in use to cooperate with said anvil and to cut through a printing medium tape leaving an uncut area corresponding to said notch; and control means arranged to control the tape printing device to have a strip label mode of operation in which the cutting blade is arranged to produce a plurality of cuts along a length of printing medium tape to provide a series of partially connected labels.

21. A tape printing device for printing an image on a printing medium tape, the device comprising:

a cassette receiving bay for receiving a cassette of printing medium tape;

a single cutting blade having a cutting surface in which there is defined a notch;

an anvil for supporting printing medium tape during printing so that the cutting surface of the blade is arranged in use to cooperate with said anvil and to cut through a printing medium tape leaving an uncut area corresponding to said notch; and a second cutting arrangement arranged in use to cut completely through the printing medium tape.

22. A tape printing apparatus for printing an image on heat shrink material in the form of a tape;

means for receiving a supply of heat shrink material;

cutting means comprising a resiliently mounted blade having a cutting surface in which there is defined a notch; and drive means controllable to actuate the cutting means so as to cut partially through heat shrink material on which a message has been printed.

23. A tape printing device for printing an image on an image receiving medium, comprising:

a cassette receiving bay for receiving a cassette of printing medium tape;

an opening provided between the cassette receiving bay and an exterior of the tape printing apparatus, said cassette receiving bay accommodating a first portion of the cassette, a second portion of the cassette being external to the tape printing apparatus and an intermediate portion of the cassette connecting the first and second portions being arranged in said opening; and printing means for printing an image on said printing medium tape.

24. A tape printing apparatus for printing an image on an image receiving medium, comprising:

a cassette receiving bay for receiving first and second types of cassettes, said cassette receiving bay being arranged to entirely receive the first type of cassette within the cassette receiving bay, the cassette receiving bay having an opening defined between the cassette receiving bay and an exterior of the tape printing apparatus so that the cassette receiving bay is arranged to accommodate a first portion of a second type of cassette in the cassette receiving bay, a second portion of the second type of cassette being external to the tape printing apparatus and an intermediate portion of the second type of cassette connecting the first and second portions being arranged in said opening.

25. A tape printing apparatus as claimed in claim 24, wherein the first type of cassette houses conventional printing medium tape.

26. A tape printing apparatus as claimed in claim 24, wherein the second type of cassette houses heat shrink material.

27. A tape printing apparatus as claimed in claim 24, which further comprises an indicating device of a cassette received in the cassette receiving bay and means for cooperating with the indicating means to thereby permit the printing apparatus to determine the type of cassette present or the type of tape present.

28. A tape printing apparatus as claimed in claim 27, which further comprises control means to control the printing device to have a multiple strip label mode when the printing device determines that a cassette of the second type is present, and a cutting blade which is controlled by the control means in the multiple strip label mode to provide a series of partially connected labels.

29. In combination, a tape printing device and a cassette housing a supply of printing medium tape, said tape printing device comprising:

a cassette receiving bay for receiving said cassette of printing medium tape;

a single cutting blade having a cutting surface in which there is defined a notch;

an anvil for supporting printing medium tape during cutting, said blade being arranged to cooperate with the anvil during cutting; and moving means for causing relative movement between the cutting blade and the anvil so that the blade is arranged to cut through the printing medium tape and to leave an uncut area corresponding to said notch.

30. In combination, a cassette of printing medium tape and a printing device for printing an image on the printing medium tape, said printing device comprising:

a cassette receiving bay for receiving the cassette of printing medium tape;

a single cutting blade having a cutting surface in which a notch is defined;

an anvil for supporting the printing medium tape during cutting so that the cutting surface of the blade is arranged during use to cooperate with the anvil and to cut through the printing medium tape leaving an uncut area corresponding to the notch; and control means arranged to control the tape printing device to have a strip label mode of operation in which the cutting blade is arranged to produce a plurality of cuts along the length of the printing medium tape to provide a series of partially connected labels.

31. In combination, a cassette housing a supply of heat shrink material in the form of a tape and a tape printing apparatus for printing an image on said tape, said tape printing apparatus comprising:

means for receiving said cassette of heat shrink material;

cutting means comprising a resiliently mounted blade and having a cutting surface in which there is defined a notch; and drive means controllable to actuate the cutting means so as to cut partially through the heat shrink material on which a message has been printed.

32. The combination of a cassette having a neck portion between first and second portions, said cassette housing a supply of printing medium tape, and a printing device, said printing device comprising:

a cassette receiving bay for receiving the cassette;

an opening provided between the cassette receiving bay and an exterior of the tape printing apparatus for accommodating the neck portion of the cassette; and printing means for printing an image on said printing medium tape, wherein the first portion of the cassette is received within the cassette receiving bay of the printing device and the second portion is positioned externally of the tape printing device, said second portion being arranged to store said printing medium tape, and said neck portion being accommodated in said opening.

33. A tape printing device as claimed in claim 1, wherein the cutting surface of the single cutting blade is straight.

* * * * *

UNITED STATES PATENT AND TRADEMARK OFFICE

CERTIFICATE OF CORRECTION

PATENT NO. : 5,676,478

DATED : October 14, 1997

INVENTOR(S) : BOWMAN, et al.

It is certified that error appears in the above-identified patent and that said Letters Patent is hereby corrected as shown below:

On the title page, Item [73],

Change assignee name from "Esselte Dymo N.V." to: ESSELTE N.V.

Signed and Sealed this

Twenty-first Day of April, 1998

Bruce Lehman

*Attest:*

BRUCE LEHMAN

*Attesting Officer*

*Commissioner of Patents and Trademarks*